United States Patent [19]

Walsh

[11] 4,252,256

[45] Feb. 24, 1981

[54] COMPRESSIBLE DRINKING APPARATUS

[76] Inventor: Edward E. Walsh, 3512 Highland View Dr., Austin, Tex. 78731

[21] Appl. No.: 57,386

[22] Filed: Jul. 13, 1979

[51] Int. Cl.[3] ..... B65D 37/00

[52] U.S. Cl. ..... 222/211; 150/0.5; 215/1 A; 222/527

[58] Field of Search ..... 222/92, 95, 104, 107, 222/143, 464, 527, 530, 211; 215/1 A; 150/0.5

[56] References Cited

U.S. PATENT DOCUMENTS

| | | | |
|---|---|---|---|
| 2,805,001 | 9/1957 | Biederman | 222/211 |
| 2,886,084 | 5/1959 | Davison | 150/0.5 |
| 3,134,515 | 5/1964 | Callahan | 222/211 |
| 3,456,850 | 7/1969 | Uhlmann | 222/211 |
| 4,157,103 | 6/1979 | Fleur | 222/527 |

*Primary Examiner*—H. Grant Skaggs
*Attorney, Agent, or Firm*—Bauer & Amer

[57] ABSTRACT

A compressible drinking apparatus includes a body rigidifying and bounding the open end of a flexible liquid-containing bag and a storage member on the bag engageable with the rigidifying body for attaining a compact storage condition of the apparatus after the bag has been emptied of liquid.

8 Claims, 7 Drawing Figures

COMPRESSIBLE DRINKING APPARATUS

The present invention relates to squeeze-type liquid dispensing containers.

Runners, and particularly those participating in marathon races as where the continuous distance covered is approximately 26 miles, require relatively frequent liquid nourishment while running so as to prevent serious dehydration of their body fluids. Current practice is to place standard drinking cups filled with liquid at stations variously located along the race course for ready access by runners as they pass by. However, drinking from such cups unavoidedly results in spillage of much of the contained liquid even if the runner significantly slows his normal pace or may necessitate his coming to a complete stop in order to attain satisfactory ingestion of the liquid. Since marathon runners are in competition with other contestants, slowing down or stopping for even moments or a few seconds is preferably avoided and particularly since having done so it may be difficult to quickly resume one's previous rhythm or pace. Moreover, the cups, once drained of liquid, are often merely dropped to the ground and constitute a source of unsightly litter which, being wet and therefore somewhat slippery, can cause falls and consequent injury to runners subsequently traversing the same ground.

Liquid dispensing containers known in the art often require that liquid be sucked or otherwise drawn therefrom through a straw-like member. During a race, however, the strenuous and physically-taxing exercise involved causes runners to breathe rapidly in relatively short breaths and as a result it is often difficult or impossible to drink liquid through a straw. In addition, known containers are not generally refillable and the relatively high cost of each unit consequently militates against such applications since repeated replenishment of the body's fluid level, and hence the provision of several liquid dispensing containers for each participant, is necessary while running long racing distances. The disposal of the emptied containers is also a problem akin to that experienced with the use of cups. Those containers that do lend themselves to subsequent refilling and reuse are not generally practical choices for runners because even when emptied of liquid the containers are not intended to be collapsible or compressible for storage and remain too bulky and/or heavy to be thereafter carried as dead and unnecessary weight by a runner.

It is, therefore, the desideratum of the present invention to provide a liquid dispensing container from which liquid can be obtained for drinking while engaged in running and without having to slow down or come to a full stop. It is a particular object of the invention to provide a liquid dispensing container wherefrom liquid can be easily forced into one's mouth and that obviates any need to suck or otherwise draw the liquid from the container.

It is a further object of the invention to provide a liquid dispensing container that is compressible when fully emptied of liquid so as to permit the same to assume a compact form or configuration conveniently carried for subsequent refilling with liquid.

It is yet another object of the invention to provide a liquid dispensing container that is repeatedly refillable with liquid for unlimited use and that is lightweight in design and inexpensive to manufacture from readily available materials.

Further objects, features and advantages of the present invention will be more fully appreciated by reference to the following detailed description of presently preferred, but nonetheless illustrative embodiments in accordance with the present invention when taken in conjunction with the accompanying drawings, wherein.

DETAILED DESCRIPTION OF THE PREFERRED EMBODIMENTS

Figure 1:
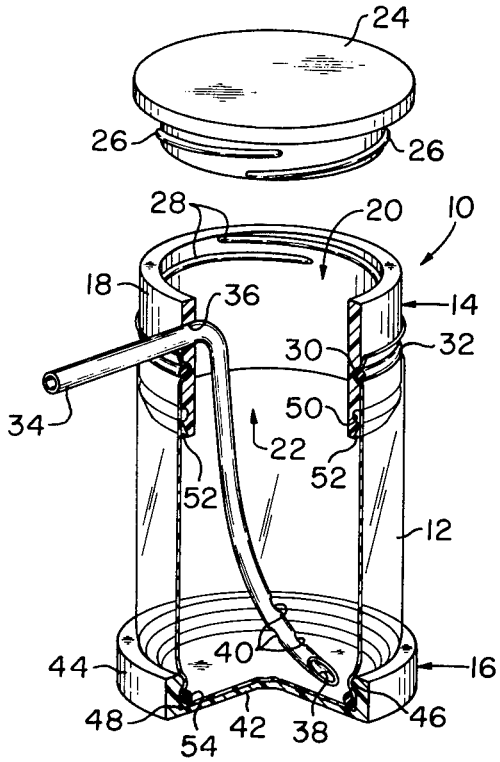
FIG. 1 is an elevational view, partially broken away, of a liquid dispensing container constructed in accordance with the teachings of the present invention.
Figure 2:
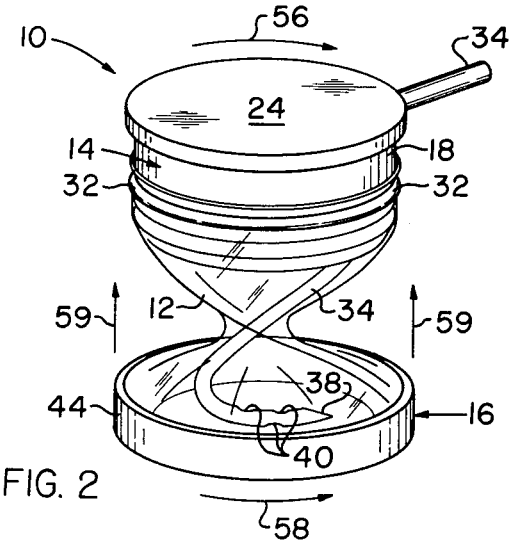
FIG. 2 is an elevational view of the liquid dispensing container of FIG. 1 demonstrating the manner of compressing the same for storage.
Figure 3:
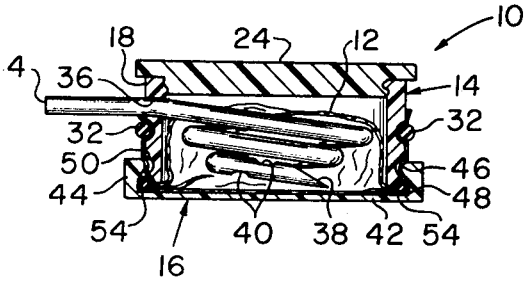
FIG. 3 is an end sectional view of the liquid dispensing container of FIG. 1 shown in its storage condition.

A compressible or collapsible drinking apparatus identified by the general reference numeral 10 and constructed in accordance with the present invention is shown in several stages of expansion and compression in FIGS. 1 to 3. More particularly, the drinking apparatus 10 is seen in its fully expanded condition in FIG. 1 wherein the same may contain a quantity of a liquid to be dispensed therefrom. The liquid is held in a conventionally constructed flexible bag 12 of plastic or the like, the size and general configuration of the bag forming no part of the present invention.

The invention herein described is directed to a neck member generally designated 14 and to a storage enabling member similarly identified 16 for cooperative or coupled engagement with the neck 14. The cooperable members 14, 16 are utilized in combination with the conventional flexible liquid-containing bag 12 to attain a collapsible liquid dispensing structure or apparatus as will hereinafter become clear.

The neck member 14 is seen to comprise a tubular body delineating a continuous wall 18 of substantially circular cross-sectional configuration and may be molded or otherwise formed of a relatively rigid and lightweight construction material such as plastic. The tubular body is open at its axially opposite top and bottom ends 20, 22 respectively so that the wall 18 peripherally bounds a hollow interior which communicates with and through the open ends 20, 22. An end or filler cap 24 rotatively engageable with the neck member or body 14 for closing its open top end 20 carries threads 26 cooperable with correspondingly configured threads 28 internally defined adjacent the top end 20 of the wall 18 to form a substantially fluid-tight connection or seal between the cap 24 and neck 14.

An annular groove 30 is recessed into the outer periphery of the tubular wall 18 at a location axially intermediate its top and bottom ends 20, 22. The groove 30 is intended to accommodate an elastic band or bead 32 for fluid-tightly retaining the flexible bag 12 to and about the neck member 14. Thus, the band 32 engages about the flexible wall of the bag 12 adjacent its open end or neck so that the bag is deformedly captured between the band 32 and recessed groove 30 and fluid-tightly held to the tubular wall 18. This simple, yet effective, connection enables the bag to be changed and replaced when desired.

It will be recognized that this arrangement of elements results in a composite structure in which a flexible bag is provided with a relatively rigidly-defined and annularly-bounded neck or opening closable by virtue of the filler cap 24 which rotates into end-sealing engagement with the rigidifying tubular wall 18. This arrangement permits the flexible bag 12 to be filled with water or other liquid through the open top end 20 of the neck member 14 and to be thereafter fluid-tightly sealed against loss of the liquid contained in the bag through a cooperative engagement of the neck closure cap 24 with the rigidifying wall 18.

A hollow tube or straw 34 for communicating bag-contained liquid to the exterior of the drinking apparatus 10 is frictionally or otherwise fluid-tightly journalled through a bore 36 defined in the wall 18 between its open top end 20 and the bag-receiving and retaining groove 30. The straw 34 is formed of a flexible material able to withstand repeated deformation and re-enlargement or distension as will soon become clear and is seen to be of sufficient length to extend in and through the full length of the bag 12. The internally disposed end of the straw 34 is accordingly permitted to rest along the bottom of the bag and is provided with an elliptical or otherwise elongated opening 38 so as to frustrate inadvertent closure of the opening by the flexible construction material of the bag 12 and to enable removal of remaining small amounts of liquid from the bag bottom. A series of apertures or pores 40 may also be included along a portion of the length of the straw 34 to generally facilitate dispensing of contained liquid through the straw.

It can accordingly be appreciated that when the bag 12 is filled with liquid and the end cap 24 positioned in end-sealing engagement on the rigidifying neck 14, the contained liquid may be dispensed from the drinking apparatus 10 through the straw 34. It is intended that the liquid be dispensed by applying an inwardly directed, external force to the flexible bag 12—as by graspingly surrounding the bag with the fingers of one's hand and squeezing the bag therebetween—so as to force the liquid from the apparatus 10 through the straw 34, rather than by the application of suction through the straw by placing the same in one's mouth and drawing the liquid therethrough.

The dispensing of liquid through the straw 34 may accordingly be controlled by the user merely by varying the amount of external pressure applied to the walls of the flexible bag 12 so as to correspondingly alter the force on the liquid and the rate at which the same is dispensed. Moreover, by suspending, as in a rack, or grasping the drinking apparatus 10 only at the rigidifying neck piece or member 14, the outward flow of liquid through the straw 34 can be halted since no external pressure or force will be applied to the walls of the bag 12 and hence to the liquid contained therein for forcing the same from the apparatus 10.

As understood, running or participating in other types of strenuous exercise causes the participant to breathe in relatively short and rapid breaths which may render it difficult to draw or suck liquid through a straw in the conventional manner. The apparatus 10 of the present invention, therefore, enables the contained liquid to be externally squeezed or forced from the flexible bag whereupon the stream of liquid emanating from a straw can be directed into one's mouth for drinking or over one's face or body as desired. The deformable and compressible nature of the bag 12 enables the same to be effectively reduced in its internal volume as the liquid is forced from the bag and the amount of contained liquid correspondingly decreases and consequently obviates the need for a return aperture in the apparatus 10 through which air would normally be admitted into the interior of the bag 12 for displacing the dispensed liquid. In other words, the bag 12 is compressed as the contained liquid is dispensed therefrom and the composite apparatus 10 therefore correspondingly decreases in size as the amount of contained liquid is reduced.

When the flexible bag 12 has been fully drained of liquid, the invention contemplates collapse of the drinking apparatus 10 to a compact storage condition or configuration in which the same may be readily and conveniently carried by a runner without interfering with the physical activity in which he is primarily engaged. For this purpose, a storage enabling member or cap 16 is connected to the flexible bag 12. As seen in FIG. 1, the storage member or cap 16 is carried on an end of the bag opposite its open end or neck although it should be recognized that the location on the bag 12 at which the connection with the storage cap 16 is effected is not critical so long as the storage enabling member 16 functions as intended and hereinafter disclosed.

More particularly, the storage cap 16 comprises a substantially flat closure surface or plate 42 from which an upstanding, continuous and substantially circular sidewall 44 depends. The sidewall 44 carries at its rim a radially inwardly projecting annular ridge 46 which may be arcuately configured and which further bounds a recessed annular channel or seat 48 defined in the sidewall 44 intermediate the ridge 46 and the cap surface 42 from which the sidewall depends.

The storage cap 16 is intended to cooperatively engage the neck member 14 when the flexible bag 12 has been fully emptied of liquid. To effect this cooperative or coupled engagement, the neck member 14 is provided with an additional annular groove or channel 50 on its outer periphery adjacent the open bottom end 22 thereof. The groove 50 is recessed in the wall 18 to retainingly accommodate the projecting ridge 46 of the storage cap 16 in a manner hereinafter described. As will be understood, this engagement is facilitated by the further provision of a tapered lip 52 on the outer periphery of the neck member 14 at its bottom end 22.

Connection of the storage cap 16 to the flexible bag 12 is effected by capturing a wall portion of the bag between a retaining bead 54 disposed in the interior of the bag and the storage cap channel 48 within the defines of which the bead 54 is accommodated. Thus, the captured portion of the bag 12 abuts the interior surfaces of the storage cap 16 including the radially inner surface of the sidewall 44 and the closure surface 42. When the bag 12 is filled with liquid, the bag is essentially suspended or hung from the neck member 14 in the manner shown in FIG. 1 and carries the storage cap 16 contiguously or abuttingly along a portion of the exterior or outer surface of the bag.

During use, of course, the liquid contained in the drinking apparatus 10 is controllably dispensed through the straw 34 in the manner previously described until virtually no liquid remains within the flexible bag 12. The apparatus 10 may then be compressed to its collapsed storage condition by relatively rotating the neck member 14 and storage cap 16 in axially opposite directions in the manner shown in FIG. 2 and illustrated by the reference arrows 56, 58 so as to twistingly deform and compress the flexible bag 12 and straw 34. Concurrent with their relatively opposite-directed rotations, the neck and storage enabling members 14, 16 are moved toward one another, as indicated by the reference arrows 59, into their final cooperative or coupled engagement.

Specifically, when the storage cap 16 is moved into contact with the neck member 14, its radially inwardly projecting ridge 46 rides over and along the tapered lip 52 of the neck member 14 and into captured engagement within the groove or channel 50 thereof. The ridge 46 and/or the sidewall 44 which carries the same may advantageously be formed of a relatively rigid but somewhat resiliently deformable material such as plastic to enable a flexure of the ridge 46 as the same rides over the tapered surface 52 and into the retaining groove 50. However, neither the material of construction nor the relative flexibility, as well as the precise configuration, of the storage cap 16 are critical to the practice of the invention and accordingly this description should not be deemed a limitation on its scope.

The fully collapsed and compact storage condition of the compressible drinking apparatus 10 is shown in FIG. 3 wherein the storage cap 16 is cooperatively engaged about the lower portion of the neck member 14 to form a relatively small, disk-like constructural arrangement. The flexible bag 12, and the portion of the straw 34 disposed within the bag 12, are deformedly or twistedly disposed in the hollow interior of the neck member 14 and are retained and captured therein by the storage cap 16 cooperatively engaged with the neck 14. As a consequence, in its collapsed storage condition of significantly compressed and reduced size the drinking apparatus 10 may be conveniently and unobtrusively carried by a runner in a small pocket or the like without interfering with his activity.

Figure 5:
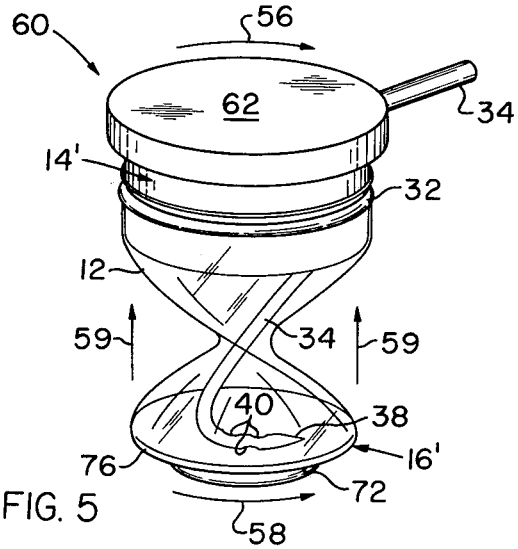
FIG. 5 is an elevational view similar to FIG. 2 demonstrating the manner of compressing the container of FIG. 1 for storing.
Figure 6:
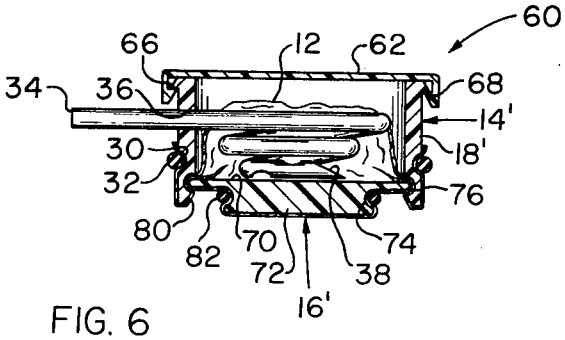
FIG. 6 is an end sectional view similar to FIG. 3 of the container of FIG. 1 shown in its storage condition.

Those skilled in the art will readily recognize that many modifications and changes may be effected to the various structures and elements comprising the disclosed compressible drinking apparatus 10. Some of these modifications are included in an alternative embodiment of the apparatus identified by the general reference numeral 60 in FIGS. 4 to 6 and which will now be described. However, at the outset it should be understood that much of the constructural arrangement of the modified drinking apparatus 60 is virtually identical to that of the earlier-described embodiment 10. A repetition here of the details of the common structures would consequently be redundant and superfluous and is omitted. For convenience and understanding, similar reference characters have been applied to the similar elements in both embodiments 10 and 60 of the inventive drinking apparatus and only the major constructural differences therebetween will be particularly pointed out. However, those skilled in the art will appreciate that individual ones of the modifications shown and identified in FIGS. 4 to 6 can be separately and selectively embodied in the apparatus 10 of FIGS. 1 to 3 to form a composite structure in accordance with the contemplation and teaching of the present invention.

Figure 4:
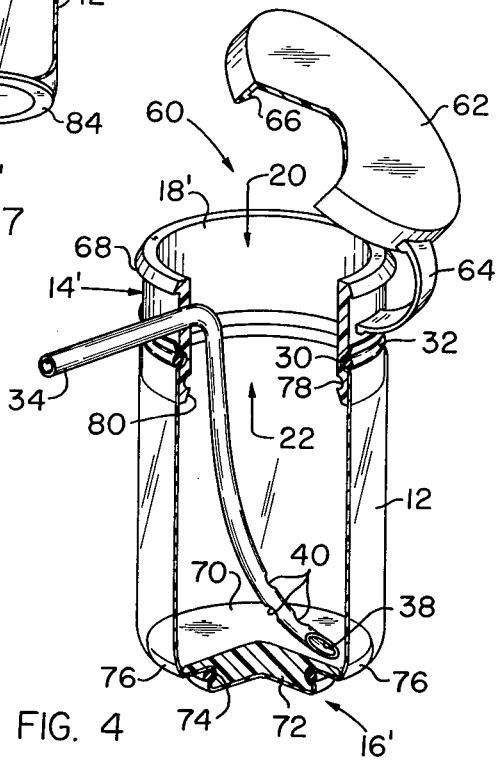
FIG. 4 is an elevational view, partially broken away, of another embodiment of a liquid dispensing container according to the present invention.

Referring then to FIG. 4, the modified drinking apparatus 60 includes a neck member 14' formed as a tubular wall 18' and which generally resembles the member 14 of the apparatus 10. The apparatus 60 includes an end or filler cap 62 which is flexibly attached to the neck member 14' at a connecting hinge 64. The cap 62 is adapted for closing or sealing engagement over the open top end 20 of the neck member 14' by the provision of a radially inwardly extending annular shoulder 66 on the cap 62 which cooperatively engages a radially outwardly projecting annular flange 68 defined on the tubular wall 18' adjacent its open top 20. Although preferably fabricated of relatively rigid construction materials, either the filler cap 62 or the neck member 14', or both, may be formed of a construction material having sufficient flexibility and resilience to enable a slight flexure in the area of the cooperatively engaging shoulder 66 and flange 68 so as to facilitate a substantially fluid-tight and positively-retained sealing engagement therebetween. Thus, instead of the mutually threaded engagement of the cap 24 and neck member 14 shown in FIG. 1, the present end cap 62 provides for a snap-fitted engagement over the open end 20 of the modified neck member 14'. The flexible hinge 64 insures that the cap 62 will not be lost or otherwise misplaced while the flexible bag is being filled with liquid.

The drinking apparatus 60 also includes a storage enabling member 16' which is structurally and operatively distinct from the similar element 16 earlier-described. The modified storage member 16' is seen to comprise a disk-like body 70 which carries a downwardly depending portion 72 of reduced cross-sectional extent and a recessed annular seat 74 defined in the depending portion 72. The peripheral edge or lip 76 of the disk 70 is curved or arcuate in shape for cooperative receipt in an annular channel or groove 78 recessed in the interior surface of the tubular wall 18' adjacent its open bottom end 22. In other words, engagement of the storage enabling member 16' with the tubular wall 18' of the neck 14' is accomplished by seating the peripheral lip or edge 76 of the storage member 16' within the defines of the receiving channel 78 of the neck member 14'. Thus, it will be understood and appreciated that the channel 78 of the neck member 14' is the functional equivalent of the similar channel or groove 50 of the neck member 14, and a like relationship exists between the peripheral lip 76 of the member 16' and the ridge 46 of the member 16. Accordingly, the tubular wall 18' may be provided with a tapered lip 80 along the axially bottom-defined interior edge thereof for the purpose of guiding the peripheral lip 76 over the wall 18' and into engagement with the channel 78.

In practice, the storage enabling member 16' is disposed in the interior of the flexible bag 12 and an elastic band or bead 82 externally of the bag is accommodated within the annular seat 74 so as to retain a wall portion of the bag 12 within the seat 74. When the drinking apparatus 60 has been fully drained of liquid, the same is compressed for storage by axially rotating in relatively opposite directions the neck member 14' and storage enabling member 16' in the manner indicated in FIG. 5 by the reference arrows 56, 58. This oppositely-directed rotation or twisting of the members 14', 16', in which the flexible bag and straw 34 are deformedly and compressingly twisted therebetween, is performed concurrent with a moving together of the members 14', 16', as denoted by the arrows 59 in FIG. 5, so as to attain the final storage condition of FIG. 6.

As there shown, accommodation of the peripheral lip 76 of the storage member 16' within the defines of the arcuate channel 78 of the neck member 14' forms a substantially captured or confined closure of the bottom end 22 of the member 14' so as to retain the compressed bag 12 and straw 34 within the hollow interior of the tubular wall 18'. As previously noted, the resulting compact disk-like storage configuration is particularly well suited to be conveniently and unobtrusively carried by a runner.

Those skilled in the art will readily recognize that the aforementioned description of the invention relates to and teaches the provision of a relatively rigid neck member or element which is used in fixedly bounding and rigidifying the open end of a conventional flexible bag, and a second or storage enabling member engageable with the neck-like element for the purpose of forming therewith a compact, bag-compressing storage structure of minimum volume. Although specific embodiments of the invention have been shown in and described with respect to the drawing, it is intended that no restriction or limitation on the scope of the invention be implied therefrom with the exception of those limitations embodied in the claims appended hereto.

Thus, by way of example, the particular configurations of the neck member 14 and of the storage enabling member 16 are not critical to the practice of the invention so long as a mutual or cooperative engagement therebetween is attainable for reaching a compact storage condition. It is within the contemplation of the invention that the storage enabling member engageable with the rigidifying neck structure take on other, simpler constructural arrangements than those depicted and described.

Figure 7:
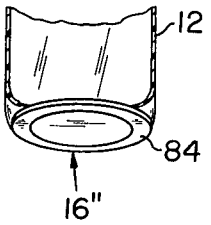
FIG. 7 is an elevational view, in section and partially broken away, of an alternative storage enabling member of the present invention.

There is accordingly, and still by way of example, shown in FIG. 7 a storage enabling member 16'' which may be formed substantially integral with the flexible bag 12 and which comprises an annular ring formed of a flexibly resilient material. The ring 84 may be in the nature of a conventional rubber grommet or the like which would then be engageable with a cooperatively conforming structure such as a receiving groove or channel defined on the interior wall surface of the rigidifying neck element. Thus, the annular ring 84 might be employed in the drinking apparatus 60 as a substitute for the storage enabling member 16' shown in FIG. 4. Such a substitution would clearly effect a significant decrease in the weight of the overall apparatus 60 while notably simplifying the composite structure and without sacrificing the ability to attain the advantageously compact and enclosed storage condition illustrated in FIGS. 4 and 6.

It should be noted—and those skilled in the art will undoubtedly recognize—that the specified provision of fluid-tight seals between the various elements of the invention, while preferred, is not absolutely essential to proper operation or use thereof. Thus, a small amount of water or air leakage can be tolerated without functionally interfering with the use of the inventive drinking apparatus although significant leaking could well render the apparatus so inefficient as to render the same impractical. In any event, it is not intended that the invention be necessarily limited to an apparatus in which absolutely fluid-tight connections of its various members are always maintained and the provision of essentially or substantially fluid-tight seals is deemed sufficient.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. In a compressible drinking apparatus for holding a quantity of liquid and including a deformable liquid-containing bag having an open end, a hollow neck member for substantially fluid-tight sealing engagement with the open end of the liquid-containing bag so as to enable liquid in the bag to communicate with the hollow interior of said neck member and for completing with the bag a substantially closed container for holding a quantity of liquid, flexible straw means in the liquid-containing interior of the bag and communicating fluid-tightly through said neck member with the exterior of said closed container such that when an external deforming force is inwardly applied to the bag the liquid therein contained is forced through said straw means to the exterior of the container and dispensed from said straw means for drinking, and storage enabling means on the bag and including means cooperable with said neck member such that when the contained liquid has been dispensed from the bag through said straw means said drinking apparatus is compressible to a compact, unitary storage condition in which said storage enabling means is moved into holding cooperation with said neck member while the bag and flexible straw means are deformedly disposed in the hollow interior of said neck member and therein captured by the cooperative holding of the neck member and storage enabling means, said neck member including a filling opening defined therein remote from its engagement with the bag and communicating with the hollow interior of said neck member for enabling the addition of liquid to the bag through said neck member, and a sealing cap engageable with said neck member for fluid-tightly closing said filling opening when the bag contains a quantity of liquid.

2. In a compressible drinking apparatus according to claim 1, said neck member being relatively rigid.

3. In a compressible drinking apparatus according to claim 1, means on said neck member for releasable cooperation with said storage enabling means.

4. In a compressible drinking apparatus according to claim 1, said storage enabling means being formed integral with the bag.

5. In a compressible drinking apparatus according to claim 1, said storage enabling means being carried on an end of the bag substantially opposite its open end.

6. A compressible drinking apparatus comprising a deformable bag having an opening through which liquid may be supplied to said bag, a hollow neck member having an opening through which liquid may be supplied to said bag, said bag and neck member being connected with each other to retain open said bag opening and to support said bag from said neck member, a cap releasably cooperable with said neck member for fluid tightly closing said bag opening to prevent the loss of liquid therefrom, storage means connected with said bag and cooperable with said neck member to store said bag within said neck member when liquid is dispensed from said bag to retain said bag in a compressed condition between said storage means and said neck member and being releasable from said cooperation with said neck member to enable said compressed beg to expand when a liquid is supplied thereinto, and straw means in said bag and extending outwardly therefrom to the exterior of said drinking apparatus to enable the withdrawal and dispensing of liquid from said bag, said straw means being deformable to be compactly compressed with and within said bag when said bag is compressed between said storage means and neck member.

7. A drinking apparatus as in claim 6, said straw means in said drinking apparatus extending outwardly therefrom through said neck member to enable the withdrawal of liquid from said bag.

8. A drinking apparatus as in claim 7, said connection between said bag and said neck member providing for a fluid tight connection therebetween and being releasable for exchange and replacement of said bags.

* * * * *